US011326269B2

(12) United States Patent
De Kok et al.

(10) Patent No.: US 11,326,269 B2
(45) Date of Patent: May 10, 2022

(54) ANODIZING AN ARTICLE OF ALUMINUM OR ALLOY THEREOF

(71) Applicant: Fokker Aerostructures B.V., LB Papendrecht (NL)

(72) Inventors: Johannes Marinus Maria De Kok, LN Bergen Op Zoom (NL); Vincent Kornelis Johannes Van Den Heuvel, MK Rotterdam (NL)

(73) Assignee: Fokker Aerostructures B.V., LB Papendrecht (NL)

( * ) Notice: Subject to any disclaimer, the term of this patent is extended or adjusted under 35 U.S.C. 154(b) by 0 days.

(21) Appl. No.: 16/094,033

(22) PCT Filed: Apr. 18, 2017

(86) PCT No.: PCT/NL2017/050240
§ 371 (c)(1),
(2) Date: Oct. 16, 2018

(87) PCT Pub. No.: WO2017/183965
PCT Pub. Date: Oct. 26, 2017

(65) Prior Publication Data

US 2019/0112725 A1 Apr. 18, 2019

(30) Foreign Application Priority Data

Apr. 18, 2016 (NL) ..... 2016630

(51) Int. Cl.
*C25D 11/08* (2006.01)
*C25D 11/02* (2006.01)
(Continued)

(52) U.S. Cl.
CPC ..... *C25D 11/08* (2013.01); *C25D 11/024* (2013.01); *C25D 11/18* (2013.01); *C25D 11/24* (2013.01); *C25D 11/246* (2013.01); *C25D 11/16* (2013.01)

(58) Field of Classification Search
CPC ..... C25D 11/24; C25D 11/18; C25D 11/08
See application file for complete search history.

(56) References Cited

U.S. PATENT DOCUMENTS 4,127,451 A * 11/1978 Marceau ..... B32B 15/20 156/151
4,229,266 A 10/1980 Usbeck
(Continued)

FOREIGN PATENT DOCUMENTS

CN 101128624 A 2/2008
CN 101280449 A 10/2008
(Continued)

OTHER PUBLICATIONS

International Search Report and Written Opinion for PCT/NL2017/050240 dated Jul. 3, 2017 (11 pages).
(Continued)

*Primary Examiner* — Brian W Cohen
(74) *Attorney, Agent, or Firm* — Bejin Bieneman PLC

(57) ABSTRACT

A method of anodizing an article of aluminum or aluminum alloy for forming a porous anodic oxide coating comprises an immersion step of immersing the article to be anodized in an electrolyte in a tank, wherein the electrolyte comprises an aqueous solution of 5-50 g/l sulphuric acid and 2-50 g/l phosphoric acid, and arranging the article as an anode with respect to one or more counter electrodes as arranged cathodes in the electrolyte, and an anodizing step of applying a positive anode voltage Va to the article, while the temperature of the electrolyte is in the range of 33-60° C.

17 Claims, 2 Drawing Sheets

(51) Int. Cl.

| | |
|---|---|
| ***C25D 11/24*** | (2006.01) |
| ***C25D 11/18*** | (2006.01) |
| ***C25D 11/16*** | (2006.01) |

(56) References Cited

U.S. PATENT DOCUMENTS

| | | | | |
|---|---|---|---|---|
| 4,859,288 | A * | 8/1989 | Furneaux | B01D 67/0065 205/75 |
| 5,486,283 | A * | 1/1996 | Mnich | C25D 11/12 205/174 |
| 2003/0196907 | A1 | 10/2003 | Viola | |
| 2005/0150771 | A1* | 7/2005 | Kock | C25D 11/04 205/172 |
| 2005/0276743 | A1* | 12/2005 | Lacombe | B82Y 30/00 423/447.3 |
| 2009/0107848 | A1 | 4/2009 | Ocon Esteban et al. | |
| 2014/0117840 | A1* | 5/2014 | Hatanaka | H05K 1/0274 313/498 |
| 2016/0194779 | A1* | 7/2016 | Umemoto | C25D 11/12 428/307.3 |

FOREIGN PATENT DOCUMENTS

| | | | |
|---|---|---|---|
| CN | 103318102 | A | 9/2013 |
| CN | 104015917 | A | 9/2014 |
| CN | 105274602 | A | 1/2016 |
| DE | 1621114 | A1 | 7/1977 |
| EP | 607579 | A1 | 7/1994 |
| JP | S55-28400 | A | 2/1980 |

OTHER PUBLICATIONS

Yendall K A et al: "Novel methods, incorporating pre- and post-anodising steps, for the replacement of the Bengough-Stuart chromic acid anodising process in structural bonding applicat", International Journal of Adhesion and Adhesives, vol. 29, No. 5, Dec. 24, 2008, pp. 503-508, XP029078598, ISSN: 0143-7496, DOI: 10.1016/J. IJADHADH.2008.11.001 Section 2.1. Materials and processes.

Gregory Boisier et al: "FESEM and EIS Study of Sealed AA2024 T3 Anodized in Sulfuric Acid Electrolytes: Influence of Tartatic Acid", Journal of the Electrochemical Society, vol. 155, No. 11, Jan. 2008, p. C521, XP055329508, US ISSN: 0013-4651, DOI: 10.1149/1.2969277 Experimental section.

Chinese Office Action for Application No. CN201780024108.6 dated Apr. 22, 2020 (23 pages; with English translation).

JPO Notification of Reasons for Rejection for Patent Application No. JP2019-056336 dated Jan. 5, 2021 (14 pages; with English translation).

* cited by examiner

ANODIZING AN ARTICLE OF ALUMINUM OR ALLOY THEREOF

CROSS-REFERENCE TO RELATED APPLICATIONS

This application is a national stage of, and claims priority to, Patent Cooperation Treaty Application No. PCT/NL2017/050240, filed on Apr. 18, 2017, which application claims priority to Netherlands Application No. NL 2016630, filed on Apr. 18, 2016, which applications are hereby incorporated herein by reference in their entireties.

BACKGROUND

Anodizing is an electrolytic passivation process that is used to increase the thickness of the (natural) oxide layer on the surface of metal parts. In anodizing a direct current is passed through an electrolyte. The part to be treated forms the anode electrode (positive electrode) of the electrical circuit. Anodizing increases resistance to corrosion and wear, and provides better adhesion for paint primers and adhesives than does bare metal. Among the anodizing processes known in the art are anodizing in an electrolyte comprising chromic acid (also referred to as "CAA"), and similarly anodizing in an electrolyte comprising phosphoric acid ("PAA"), anodizing in an electrolyte comprising sulphuric acid ("SAA") and anodizing in an electrolyte comprising phosphoric acid and sulphuric acid ("PSA").

EP 607579 A1 has disclosed a method of anodic oxidation of structural elements as used in aerospace technology made of aluminum and its alloys or manganese and its alloys.

According to this known method the structural elements are brought into contact with an aqueous electrolyte comprising both sulphuric acid and phosphoric acid. Preferred conditions include a concentration of approximately 100 g/l of both sulphuric acid and phosphoric acid compounds, a temperature of about 27° C., an applied voltage between 15-20 V, a dwell time at constant voltage of about 15 minutes following a so called ramp up time of about 3 minutes. This anodizing process was approved and qualified, and is known in the field as the standard PSA process.

Anodized articles of aluminum or its alloys are applied in structural adhesive metal bonding. In modern aerostructures, panels, sheets or extruded profiles of aluminum or its alloys after being anodized as discussed above, are bonded together using an adhesive. A further well-known application comprises a sandwich structure, wherein one or more (glass) fiber reinforced layers are interposed between aluminum panels or sheets using adhesive bonding resulting in a so called fiber metal laminate (FML). This known process has offered beneficial performance results with respect to durable adhesion with AA2024-T3 alclad and hot curing (thermosetting) epoxy adhesives in combination with the corrosion inhibiting bonding primer BR127, which is a modified epoxy primer that contains chromate (Cr(VI).

Because Cr(VI)) as present in chromic acid and chromates is toxic and carcinogenic, there is a need to eliminate all chromates in the metal bonded products and their manufacturing processes. Alternative Cr(VI) free bonding primers have been developed. However, until now the worldwide efforts have not resulted in a bonding performance that matches that of the chromate BR127 based bonding system.

Thus the need for eliminating Cr(VI) compounds from the metal bonded products continues to exist and is becoming more and more urgent as there is a tendency to reduce the legally allowed applications of Cr(VI) compounds, and full prohibition is expected.

SUMMARY

The present disclosure relates to a method of anodizing an article of aluminum or aluminum alloy, applications thereof, manufacturing methods using article(s) thus anodized, an apparatus for performing the anodizing method and anodized articles and products, in particular aerostructural components. Disclosed is a method of structural adhesive metal bonding, wherein Cr(VI) compounds are not mandatory in the various manufacturing steps of metal bonded products for achieving favorable characteristics thereof like corrosion resistance and/or bond performance.

Surprisingly it has been found that—by adjusting the anodizing process—bonding performance using non-chromate bonding primers can be improved to a level that is similar or even better than the performance based on the bonding primer BR127 that contains chromate (Cr(VI)).

Accordingly a method of anodizing an article of aluminum or aluminum alloy for applying a porous anodic oxide coating in preparation of the subsequent application of an adhesive bonding layer and/or a bonding primer layer, can comprise:

- an immersion step of immersing the article to be anodized in an electrolyte in a tank, wherein the electrolyte comprises an aqueous solution of sulphuric acid and phosphoric acid, and arranging the article as an anode with respect to one or more counter electrodes that are arranged as cathodes in the electrolyte,
- an anodizing step of applying a positive anode voltage Va to the article, wherein the concentration of sulphuric acid in the electrolyte is in the range of 5-50 g/l, the concentration of phosphoric acid in the electrolyte is in the range of 2-50 g/l, and the temperature of the electrolyte is in the range of 33-60° C. during the anodizing step.

In the anodizing process the article is treated as in the method known from EP 607579 A1, but under substantially different conditions.

The electrolyte contains sulphuric acid in the range of 5-50 g/l and phosphoric acid in the range of 2-50 g/l, while the temperature of the electrolyte is held in the range of 33-60° C. during anodizing. Surprisingly it has been found that compared to the known standard PSA process at much lower concentrations of the inorganic acids in the aqueous electrolyte, in a much broader, though higher temperature window an anodic oxide layer is formed at the surface of the article of aluminum or of aluminum alloys, which oxide layer offers a favorable structure even when rinsing after anodizing is postponed for several minutes as encountered in industry. The structure has proven to be beneficial for the later application of a bonding primer and/or paint primer, in particular chromate free primers. The method also allows a less stringent control of temperature of the electrolyte. The amount of spent electrolyte comprising sulphuric and phosphoric acids is reduced. Surprisingly, the thus treated article can be manufactured into a bonded product, such as a layered aerostructure that comprises at least two anodized sheets or panels of aluminum or alloys thereof, which sheets are bonded together by a non-chromate adhesive binder system comprising a non-chromate bonding primer and a suitable adhesive, typically a thermosetting plastic such as epoxy, which aerostructure shows bonding performance and corrosion resistance at levels that equal those of the above BR127 bonding primer based structures.

The article that can be anodized is made from aluminum or its alloys. Examples of suitable alloys are the AA1 xxx (pure Al), AA2xxx (Al—Cu and Al—Cu—Li alloys), AA5xxx (Al—Mg alloy), AA6xxx (Al—Mg—Si alloy). AA7xxx (Al—Zn alloy) and AA8xxx (Al—Li) series, as well AA2xxx alclad and AA7xxx alclad. Typical examples include AA1050, AA2024, AA2060, AA2196, AA2198, AA2524. AA5052, AA6013, AA6061. AA7010. AA7050, AA7075, AA7175, AA7475 and AA8090, e.g. AA2024-T3 unclad, AA2024-T3 alclad and AA7075-T6 alclad.

4) The anodizing treatment can be applied to any article of aluminum or its alloys, in particular aerostructural components like hinges, stiffeners, as well as sheets and panels, that are to be treated by a suitable primer and then painted or manufactured into a metal-metal laminate or fiber-reinforced metal laminate (so called FML's).

The sulphuric acid concentration is in the range of 5-50 g/l, preferably 10-40 g/1. The phosphoric acid concentration is in the range of 2-50 g/l, preferably 2-40 g/l, and most preferably in the range of 4-16 g/l. The preferred ranges offer improved bonding performance and corrosion resistance.

Advantageously the Al content of the electrolyte is 5 g/l or less, preferably 4.8 g/l or less. During anodizing sulphuric acid is consumed and aluminum dissolves from the article being treated. It has appeared that at Al concentrations above 5 g/l bondline corrosion increases.

As mentioned above the temperature window in which the anodizing step of the method is applicable in view of bonding performance and corrosion resistance, is broad compared to the prior art and lies in the range of 33-60° C. In other words the process is less temperature dependent and thus less critical to temperature. A preferred range is 40-54° C., more preferably 40-50° C., in particular 42-48° C. in view of optimum bonding and corrosion properties.

The applied voltage is also less critical. Suitable anode voltages Va are in the range of 8-34 V. The same applies to the total anodizing time including ramp up time (time during anodizing step of gradually raising the voltage to the anodizing voltage). This total anodizing time is inter alia dependent from the component concentration(s) in the electrolyte, the applied (anodizing) voltage and desired thickness of the anodic oxide layer formed. Total anodizing times usually range from 10-45 minutes, such as 15-35 minutes. At anodizing periods of less than 15 minutes durability as measured by bondline corrosion tests is less than at longer anodizing periods.

The anodizing treatment provides a corrosion resistance at a required level for the aerostructural applications of the article. Therefore in an advantageous embodiment of the invention the electrolyte is free of any Cr(VI) compounds, and more preferably free from other additional corrosion inhibitors as well.

In a further preferred embodiment of the anodizing method according to the invention, the anodizing step comprises

- a first substep of gradually increasing the applied anode voltage to a first value (Va1) in the range of 8-34 V,
- a second substep of maintaining the applied anode voltage at said first value (Va1) for a first anodizing time,
- a third substep of raising the applied anode voltage to a second value (Va2) in the range of 8-34 V, which second value is higher than the first value, and
- a fourth substep of maintaining the applied anode voltage at said second value (Va2) for a second anodizing time.

In this preferred embodiment the anodizing step is divided into several substeps. In a first substep (ramp up time) the applied voltage is gradually raised to a set anodizing voltage (=first value=Va1) such as between 15-20 V. The gradient is not critical and is usually between 1-10 V/minute. Then the article is anodized for a first anodizing time t1 such as 10-15 minutes, after which the applied voltage is raised further to a second anode voltage Va2, e.g. 25-30V in a third substep. Again the gradient is not critical. In the fourth substep this second anode voltage is applied for a second anodizing time t2. Typically the second time t2 is less than the first anodizing time t1, such as 2-5 minutes. Such an embodiment where at the end of the anodizing process the applied voltage is increased to a higher value for a few minutes has resulted in an even better corrosion behavior.

During anodizing the electrolyte undergoes ageing and acidic components of the electrolyte are consumed and therefore typically replenished on a regular basis, in particular sulphuric acid. Compared to phosphoric acid, which is essentially in a non-dissociated state at the prevailing pH, phosphoric acid is the main reactant from the electrolyte in the reaction with aluminum oxide. During anodizing also some aluminum (and other alloying elements) from the article being anodized dissolves into the electrolyte. In view of bonding and corrosion properties it has appeared beneficial to maintain the aluminum concentration in the electrolyte at a value below 5 g/l, such as 4.8 g/1 or less.

Typically the article having an anodic coating thus obtained is rinsed and dried. This article is a semi-product, which is advantageously further processed.

In one application the anodized article is primed with a suitable paint primer and then painted, advantageously using high solid solvent-based and/or water-based primer and paint systems. Accordingly the disclosure includes a method of manufacturing a painted anodized article, comprising providing an anodized article by the above anodizing method, applying a paint primer to the surface(s) to be painted of the anodized article and painting the primed surface(s) of the article. Optionally a bonding primer may be applied between the anodized article and the paint primer.

In another application the anodized article is manufactured into a bonded product, such as an aircraft skin panel bonded together with a stiffener, or a metal metal laminate or a fiber-reinforced metal metal laminate. Surfaces to be bonded of the metal articles that were anodized as described hereinbefore, such as sheets or panels or stiffeners, are primed with a suitable bonding primer and then at least one surface to which the bonding primer has been applied, is provided with a suitable adhesive. The metal articles are stacked having the surfaces to which the bonding primer and/or adhesive has been applied facing each other and then are bonded together typically at elevated pressure and at elevated temperature in a press or autoclave, or using standard out-of-autoclave techniques. Thus a multilayered bonded product like a metal laminate can be manufactured. The bonding primer is preferably a solvent-based and/or a water based, non-chromated primer. Optionally a metal bonded laminate may be produced from metal sheets that were anodized according to the invention, using a fiber-reinforced adhesive, such as a fiber layer that is pre-impregnated with the adhesive ("pre-pregs") in order to manufacture fiber-reinforced metal laminates.

Examples of bonding primers suitable for use in the above applications include epoxy/phenolic, chromated, corrosion inhibited, solvent based adhesive primer, such as BR127 from Cytec Engineering Materials; epoxy, non-chromated, corrosion inhibited, water based adhesive primers available from 3M and Henkel; epoxy/phenolic, non-chromated, corrosion inhibited, water based adhesive primers, e.g. BR252 from Cytec Engineering Materials; epoxy, non-chromated, non-corrosion inhibited, solvent based adhesive primers, e.g. Redux 112 and Redux 119 available from Hexcel and those from Cytec Engineering Materials and 3M; phenol formaldehyde, non-chromated, non-corrosion inhibited, solvent based adhesive primers, such as Redux 101 from Hexcel.

Examples of adhesives that can be applied include cold curing adhesive pastes; 120° C. curing adhesive epoxy films, such as available from 3M, Cytec Engineering Materials, Henkel and Hexcel; 150° C. curing vinyl phenolic adhesive; and 177° C. curing adhesive epoxy films.

Fiber reinforced adhesives include inter alia 120° C. curing epoxy prepreg FM94S2 available from Cytec Engineering Materials and 180° C. curing epoxy prepreg FM906S2 from Cytec Engineering Materials.

Paint primers to be applied to the anodized surfaces, or on top of above bonding primers, include conventional paint primers. e.g. epoxy, chromated, corrosion inhibiting, solvent-based primer; modified epoxy, chromated, corrosion inhibited, solvent based primer, epoxy, water-based, corrosion inhibiting primer; isocyanate based modified epoxy (non-chromated) primer; as well as magnesium rich primer. Further suitable paint primers are latest technology paint primers, like epoxy, non-chromated, corrosion inhibited, water based paint primer; and high-solid, non-chromated, corrosion inhibited paint primer.

The articles of aluminum or aluminum alloy that are anodized may be bonded together and/or bonded with anodized parts made of the same aluminum or alloy thereof or a metal or metal alloy other than aluminum or its alloys, for manufacturing a metal bonded product, such as a metal bonded structural aerostructural part (e.g. a metal aircraft skin with bonded metal stiffeners, or a metal laminate skin made of bonded aluminum sheets) or a fiber metal laminate, made of stacked aluminum sheets that are bonded together with layer(s) of reinforcing fibers embedded in an adhesive, which are positioned between the sheets of aluminum or aluminum alloys.

Thus the invention further relates to an aerostructural component like a skin panel of a wing, horizontal tail plane, vertical tail plane or fuselage, that comprises a painted anodized article that was made according to the above manufacturing methods using paint and/or bonding systems. Advantageously the aerostructural component comprises a chromate (Cr(VI)) free bonding primer.

In yet another aspect the disclosure includes to a metal bonded product made according to the metal bonding manufacturing method as described above, which product has a bondline corrosion of 5% or less as measured at machined edges of 25 mm wide strips of bonding surfaces, after exposure to neutral salt spray during 90 days according to ISO 9227.

The method for anodizing an article of aluminum or aluminum alloy for applying a porous anodic oxide coating in preparation of the subsequent application of an adhesive bonding layer and/or a primer layer can be performed in an apparatus, comprising an immersion tank for containing a liquid electrolyte, a direct voltage source, one or more counter electrodes, an anode connector for connecting to the article to be anodized, and means for controlling the electrolyte temperature, wherein the electrolyte comprises sulphuric acid in a concentration in the range of 5-50 g/l, and phosphoric acid in a concentration in the range of 2-50 g/1.

The preferred embodiments described hereinbefore are equally applicable to the apparatus.

SUMMARY OF THE DRAWINGS

Examples are further illustrated by the attached drawing, wherein.

DESCRIPTION

Figure 1:
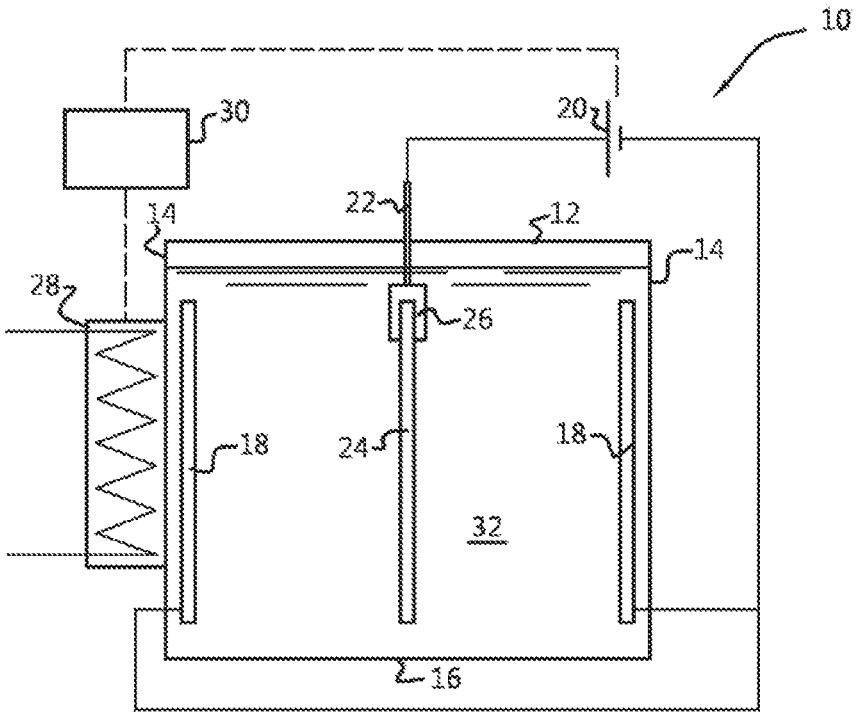
FIG. 1 is a diagrammatical view of an example apparatus for carrying out the anodizing.

In FIG. 1 an example of an apparatus for anodizing an article of aluminum or aluminum alloy is represented diagrammatically. The apparatus in its entirety is indicated by reference numeral 10. The anodizing apparatus 10 comprises an immersion tank 12 having upstanding walls 14 and a bottom 16. Along one or more of the walls 14, in particular pair(s) of opposite walls counter-electrodes 18 are arranged, which are electrically connected as cathodes to a DC voltage source 20. A support 22 carries the article 24 to be anodized. The article 24 is electrically connected as an anode to the DC voltage source 20 by means of an anode connector 26. A heat exchanger 28 controlled by control unit 30 is provided as a temperature regulator enabling maintaining the anodizing temperature of a liquid electrolyte 32, that is contained in the tank 12, at a desired temperature value. The electrolyte 32 is an aqueous solution of sulphuric acid and phosphoric acid in a concentration of 5-50 g/1 and 2-50 g/l respectively. During operation the liquid electrolyte is typically replenished partially on a regular basis. The Al content is maintained at a level below 5 g/1. The tank 12 has an open top side so that the article 24 can be brought into the tank 12 from above and dipped into the electrolyte 32, and after anodizing can be lifted upwardly out of electrolyte 32 and the tank 12.

Figure 2:
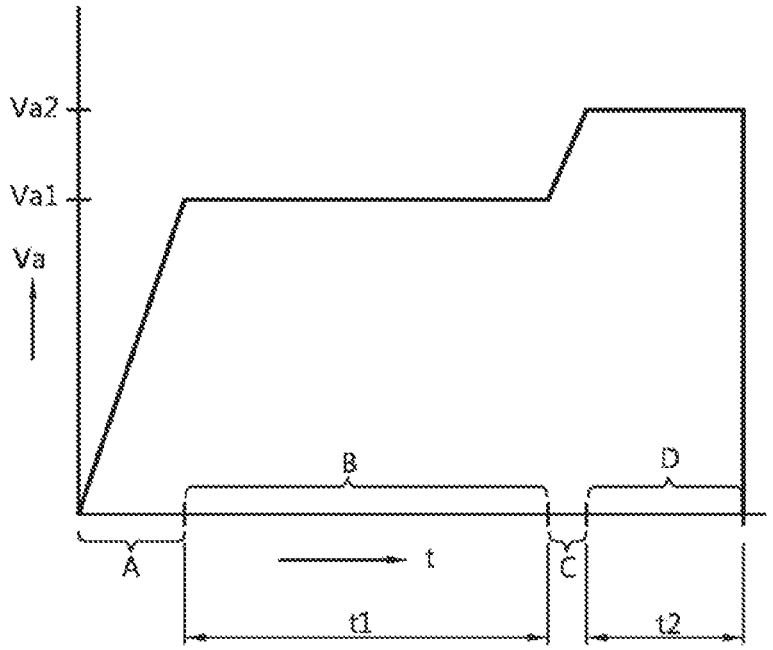
FIG. 2 is a diagram showing the course of the anodic voltage as a function of time in an example of the anodizing method.

FIG. 2 shows a preferred embodiment of the anodizing method as a plot of the anodic voltage Va (V) as a function of time (minutes), wherein initially the anodic voltage is raised at 1-10 V/min in a first substep A to a first anodic voltage Va1, such as 17 V. During a second substep B the anodic voltage Va1 is maintained for a first period of time t1 such as 10-20 minutes. At the end of this first period of time the anodic voltage is increased to a second anodic voltage Va2 in a third substep C and held at this voltage Va2 in a fourth substep D during an additional period of time t2, which is usually in the range up to 5 minutes.

Experimental details and data about this embodiment for varying Va1, Va2, t1 and t2 are presented in Table 5, below.

Experiments

Extensive and careful investigations of the standard PSA process have shown that the narrow temperature tolerance associated with this standard PSA process is defined and imposed by the porous oxide structure to be achieved for bonding. With increasing temperature such as at 29±2° C. (Tmax 29.5° C.) and 30±1° C. (Tmax 31.7° C.) (120 g/l phosphoric acid+80 g/l sulphuric acid; Va=18 V) significant oxide dissolution occurs that affects the porous oxide structure, as has been evidenced by SEM pictures.

Figure 3:
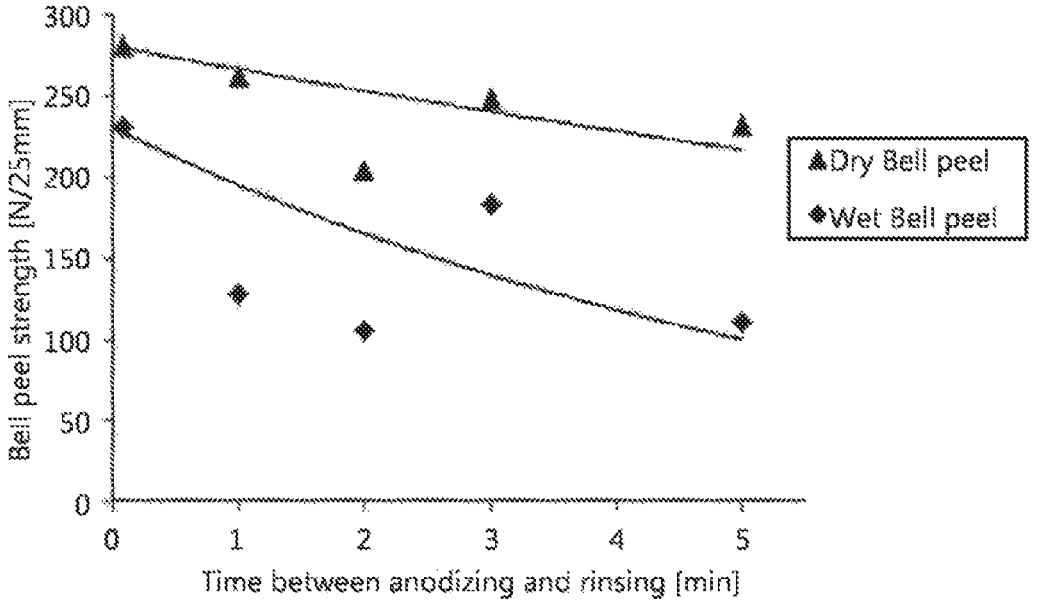
FIG. 3 is a diagram showing the Bell peel strength versus rinse delay time of AA2024-T3 unclad, anodized at 28° C., with 120 g/l phosphoric acid and 80 g/1 sulphuric acid, and subsequently provided with phenol formaldehyde bonding primer Redux101 and bonded with 125° C. curing epoxy adhesive AF163-2K.

Moreover, after anodizing the electrolyte needs to be removed such as by spray rinsing or immersion rinsing. On a lab scale the samples can be rinsed within seconds, such as 5 seconds. In commercial installations handling sheets of e.g. measuring 1 m×10 m, the time between anodizing and rinsing is in the order of minutes, typically 2±1 minutes. It has appeared that additional dissolution and thus deterioration of the porous oxide coating occurs during the delay between anodizing and removal of the electrolyte from the article by rinsing. In particular it has appeared that dissolution is most pronounced upon treating unclad aluminum alloy (e.g. AA2024-T3 bare) articles. The ultimate result of the deteriorated coating is a dramatic reduction of the adhesive bonding performance as evidenced by dry and wet Bell peel results (EN 2243-2) after testing according to EN 1967 using a non-chromate bonding primer (phenol formaldehyde bonding primer Redux 101, bonded with 125° C. curing epoxy adhesive AF163-2K), as shown in Table 1 and FIG. 3.

In the context of this disclosure for both dry and wet Bell peel tests, if a sample has a bonding strength of 200 N/25 mm or more the sample is considered to fulfil the bonding requirements.

Solved herein are the problems associated with oxide dissolution and resulting peel strength reduction by a totally different approach, allowing elimination of all chromate ((Cr(VI) compounds in the metal bonded products.

A sulphuric acid concentration of 10 g/l was selected for anodizing experiments and compared with previously tested sulphuric acid concentration of 50 g/l. Additionally the phosphoric acid concentration was varied with 0, 40 and 80 g/l to distinguish the role of the acids separately. Voltages have been varied to achieve a current density of 0.8±0.4 A/dm$^2$. Tests were first started on AA2024-T3 bare, because of the observed oxide dissolution problems, and AA7075-T6 alclad, because this alloy is in general most susceptible to bondline corrosion.

The extent of bondline corrosion is typically determined with samples of metal to metal bonded sheets that are machined to 25 mm wide strips, in the same way as peel specimens are made (e.g. according to EN 2243-2). These samples are exposed to a desired duration of neutral salt spray according to ISO 9227. The exposure to salt may, without mechanical loading, result in delamination, initiated by corrosion at the unprotected edges of the strips that were cut by machining. After the exposure the strips are peeled open to measure the extent of bondline corrosion, defined as the relative portion of the area of delamination initiated by corrosion, compared to the initial bond area. In the context of this disclosure (unless indicated otherwise) after a salt spray duration of 180 days, a bondline corrosion of 10% or less is considered "good", and after a salt spray duration of 90 days, a bondline corrosion of 5% or less is considered "good". In a 45 days lasting salt spray test 2% or less is "good".

TABLE 1

Bell peel strength values of 0.5 mm and 1.6 mm M2024-T3 unclad, anodized at 28 C. with 120 g/l phosphoric acid and 80 g/l sulphuric acid, subsequently provided with phenol formaldehyde bonding primer Redux101 and bonded with 125° C. curing epoxy adhesive AF163-2K with rinsing delay times varied.

| Anodizing | Time between anodizing and rinsing | Dry Bell peel on 2024-T3 bare [N/25 mm] | | | Wet Bell peel on 2024-T3 bare [N/25 mm] | | | Wet peel strength |
|---|---|---|---|---|---|---|---|---|
| process | (s) | #1 | #2 | average | #1 | #2 | average | reduction (%) |
| 120 g/l | 5 | 285 | 277 | 281 | 223 | 240 | 232 | =reference |
| phosphoric | 60 | 260 | 264 | 262 | 132 | 124 | 128 | 45 |
| acid + 80 g/1 | 120 | 201 | 209 | 205 | 103 | 108 | 106 | 54 |
| sulphuric | 180 | 276 | 221 | 249 | 177 | 190 | 184 | 21 |
| acid | 300 | 230 | 236 | 233 | 103 | 119 | 111 | 52 |
| at 18 V at 28 ± 1° C. for 23 min | | | | | | | | |

Figure 4:
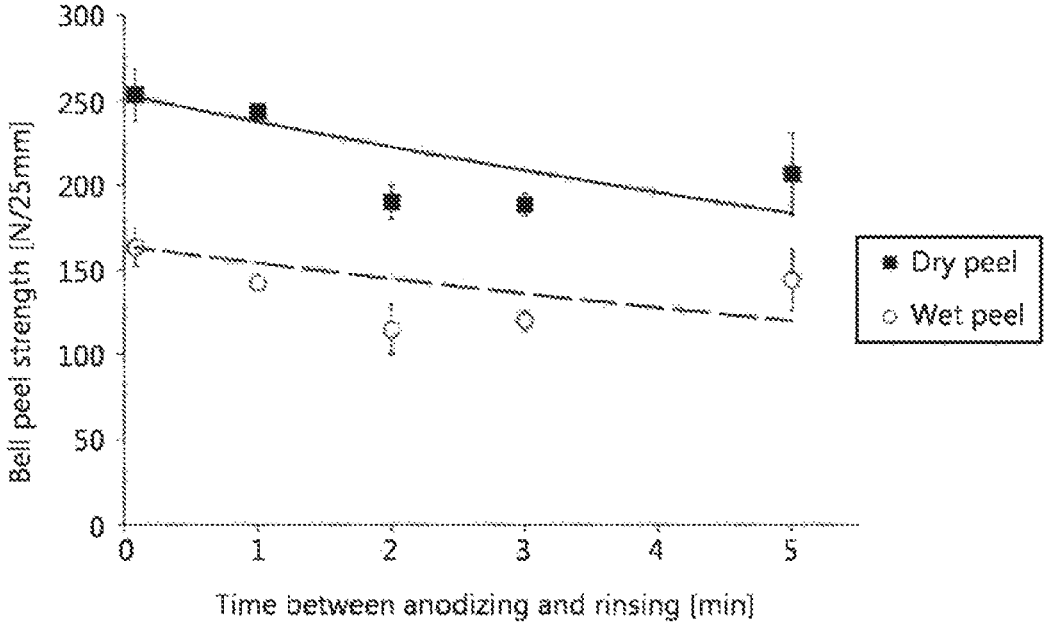
FIG. 4 is a diagram showing the Bell peel strength versus rinse delay time of AA2024-T3 unclad, anodized at 28° C., with 75 g/l phosphoric acid and 50 g/l sulphuric acid, and subsequently provided with phenol formaldehyde bonding primer Redux101 and bonded with 125° C. curing epoxy adhesive AF163-2K.

Further tests for solving the oxide dissolution problem were conducted at lower acid concentrations of 75 g/l phosphoric acid and 50 g/l sulphuric acid at essentially the same conditions regarding Va=18 V and T=28° C. In view of the lower acid concentrations the anodizing time was prolonged to 30 minutes (3 minutes ramp up and 27 minutes dwell time). Although these further tests showed that similar results regarding adhesive bonding and bondline corrosion resistance can be achieved, the delayed rinsing still had a pronounced negative effect on adhesive bonding performance as measured by Bell peel strength as shown in FIG. 4. FIG. 4 shows the Bell peel strength versus rinse delay time of AA2024-T3 unclad, anodized at 28° C. in an electrolyte comprising 75 g/l phosphoric acid and 50 g/l sulphuric acid, and subsequently provided with phenol formaldehyde bonding primer Redux101 and bonded with 125° C. curing epoxy adhesive AF163-2K.

Pretreated aluminum sheets have been provided with phenol formaldehyde bonding primer Redux 101 and bonded with 125° C. curing epoxy adhesive AF163-2K. Some typical results of bondline corrosion with AA7075-T6 alclad after 180 days salt spray exposure are given in Table 2. Table 3 offers wet Bell peel strength data for M 2024-T3. For both aluminum alloys in these Tables 2 and 3 respectively anodizing was performed at a constant voltage at the indicated current densities for 30 minutes, except #3 (20 min) in Table 3.

TABLE 2

Bondline corrosion values after 180 days salt spray exposure of 0.8 mm and 1.6 mm AA7075-76 alclad, provided with phenol formaldehyde bondprimer Redux101 and bonded with 125° C. curing epoxy adhesive AF163-2K, with anodizing parameters varied.

| Sulphuric acid concen-tration (g/l) | Phosphoric acid concen-tration (g/l) | Anodizing temperature (° C.) | Current density (A/dm2) | Bondline corrosion (%) #1 | #2 | average |
|---|---|---|---|---|---|---|
| 10 | 0 | 20 | 0.47 | 99 | 99 | 99 |
| | | 35 | 0.73 | 99 | 99 | 99 |
| | | 50 | 1.08 | 2 | 3 | 3 |
| | | 58 | | 3 | 6 | 5 |
| 10 | 40 | 20 | 0.40 | 95 | 93 | 94 |
| | | 35 | 0.85 | 2 | 3 | 3 |
| | | 50 | 1.2 | 2 | 45 | 24 |
| 10 | 80 | 20 | 0.44 | 90 | 95 | 93 |
| | | 35 | 0.78 | 2 | 4 | 3 |
| | | 50 | 1.25 | 1 | 3 | 2 |
| 50 | 0 | 20 | 0.84 | 99 | 90 | 95 |
| | | 35 | 1.03 | 55 | 50 | 53 |
| | | 50 | 1.25 | 15 | 50 | 33 |
| 50 | 40 | 20 | 0.84 | 85 | 75 | 80 |
| | | 35 | 1.15 | 15 | 6 | 11 |
| | | 50 | 1.39 | 70 | 55 | 63 |
| 50 | 80 | 20 | 1.01 | 75 | 80 | 78 |
| | | 35 | 1.17 | 10 | 15 | 13 |
| | | 50 | 1.39 | 65 | 30 | 48 |
| 80 | 120 | 28 | | 10 | 16 | 13 |

Surprisingly the best bondline corrosion results had been obtained with the lowest sulphuric acid concentration of 10 g/l, at relatively high temperatures of 35° C. to 58° C. with higher anodizing temperature being required when no phosphoric acid is present in the electrolyte. The bondline corrosion values in Table 2 indicate that the optimum anodizing temperature varies between 35° C. and 50° C. and depends also on the composition of the electrolyte.

From the above Tables 2 and 3 it appears that at a given set of process conditions no satisfying results are achieved regarding corrosion and bonding for these different alloys.

Further tests with addition of various amounts of phosphoric acid were performed, because the phosphoric acid is believed to improve adhesion, moisture resistance, and thus durability of the bondline. Tests were conducted primarily with anodizing of AA2024-T3 bare, AA7075-T6 bare, and AA2024-T3 alclad. With sulfuric acid concentration of 10, 25, and 40 g/l, respectively, temperature has been varied with 33, 40, 47 and 53° C., and phosphoric acid concentration has been varied with 2, 5, 15 and 40 g/l. Additionally the time between anodizing and rinsing has been varied to validate that problems of oxide dissolution had been solved. Anodizing voltages of 8, 15 and 22V have been applied to obtain an appropriate current density.

Wet Bell peel tests have been conducted on AA2024-T3 bare and AA7075-T6 bare according EN 1967 and a part of the results is given in Table 4 below.

The data in Table 4 indicate that with the full range of combinations of sulphuric acid concentration from 5-50 g/l, in particular 10-40 g/l, phosphoric acid concentration from 2-40 g/l, and temperature from 33-54° C. good wet Bell peel results can be obtained. When phosphoric acid concentration is 2-50 g/l, the anodizing temperature can be 33° C. and increased temperature up to 54-60° C. generally improves adhesion. With respect to rinsing delay time the temperature can be at least increased up to 54° C. at 40 g/l phosphoric acid. Additionally it appears from the test data that with all the combinations the delay of rinsing after anodizing up to 3 minutes does not result into a reduction of Wet Bell peel strength.

TABLE 3

Wet Belll peel strength on AA2024-T3 unclad provided with phenol formaldehyde bondprimer Redux101 and bonded with 125° C. curing epoxy adhesive AF163 2K, with anodizing parameters varied.

| Sulphuric acid concentration (g/1) | Phosphoric acid concentration (g/l | Anodizing temperature, (° C.) | Current density (A/dm2) | Wet Bell peel (N/25 mm) #1 | #2 | #3 | average |
|---|---|---|---|---|---|---|---|
| 10 | 0 | 20 | 0.24 | 10 | 8 | 19 | 13 |
| | | 35 | 0.42 | 15 | 5 | 14 | 11 |
| | | 50 | 0.77 | 215 | 154 | 195 | 188 |
| | | 58 | | 163 | 149 | 163 | 158 |
| 10 | 40 | 20 | 0.40 | 166 | 136 | 143 | 148 |
| | | 35 | 0.80 | 150 | 80 | 145 | 125 |
| | | 50 | 1.21 | 172 | 147 | 188 | 169 |
| 10 | 80 | 20 | 0.38 | 171 | 53 | 149 | 124 |
| | | 35 | 0.85 | 207 | 79 | 151 | 146 |
| | | 50 | 1.70 | 265 | 192 | 272 | 243 |
| 50 | 0 | 20 | 0.42 | 3 | 7 | 3 | 4 |
| | | 35 | 0.72 | 255 | 264 | 312 | 277 |
| | | 50 | 1.05 | 154 | 128 | 117 | 133 |
| 50 | 40 | 20 | 0.30 | 46 | 30 | 199 | 92 |
| | | 35 | 0.70 | 269 | 206 | 242 | 239 |
| | | 50 | 1.24 | 219 | 177 | 249 | 215 |
| 50 | 80 | 20 | 0.38 | 204 | 162 | 183 | 183 |
| | | 35 | 0.76 | 136 | 98 | 166 | 133 |
| | | 50 | 1.44 | 251 | 197 | 266 | 238 |
| 80 | 120 | 28 | | 162 | 121 | 197 | 160 |

TABLE 4

Wet Bell peel strength values of bonded samples, made of 0.5 mm and 1.6 mm AA2024-T3 bare sheets and of 0.5 mm and 1.6 mm AA7075-T6 bare sheets, by anodizing the sheets at an anodizing voltage of 15 V during 28 minutes, and by subsequent application of phenol formaldehyde bondprimer Redux101 and bonding with 125° C. curing epoxy adhesive AF163-2K. The anodizing parameters regarding sulphuric acid concentration, phosphoric acid concentration, temperature and rinsing delay time were varied.

| | | | | Wet Bell peel on 2024-T3 bare [N/25 mm] | | | Wet Bell peel on 7075-T6 bare [N/25 mm] | | | Bondline corrosion on 2024-T3 alclad (%) | | | |
|---|---|---|---|---|---|---|---|---|---|---|---|---|---|
| $H_2SO_4$ (g/l) | $H_5PO_4$ (g/l) | Temp. (° C.) | Time between anodizing and rinsing ( or min) | #1 | #2 | Relative to direct, 5 s delay rinsing (%) | #1 | #2 | Relative to direct, 5 s delay rinsing (%) | #1 45 d salt spray | #2 90 d salt spray | #3 90 d salt spray | #4 180 d salt spray |
| 10 | 2 | 33 | 5 s | 33 | 49 | | 35 | 79 | | 34 | 52 | 37 | |
| | | | 3.0 min | 78 | 99 | 215 | 60 | 149 | 184 | 11 | 10 | 28 | |
| | | 40 | 5 s | 242 | 265 | | 211 | 225 | | 5 | 7 | 13 | |
| | | 47 | 5 s | 231 | 231 | | 247 | 239 | | 1 | 6 | | 17 |
| | | 54 | 5 s | 196 | 252 | | 216 | 218 | | 0 | 5 | | 11 |
| | | | 3.0 min | 232 | 270 | 112 | 244 | 210 | 105 | 1 | 3 | 1 | |
| | 5 | 33 | 5 s | 209 | 218 | | 196 | 202 | | 8 | 30 | 40 | |
| | 15 | 33 | 5 s | 222 | 210 | | 262 | 258 | | 8 | 12 | 13 | |
| | 40 | 33 | 5 s | 217 | 225 | | 236 | 200 | | 1 | 1 | | 22 |
| | | | 3.0 min | 232 | 256 | 110 | 222 | 237 | 105 | 2 | 5 | | 20 |
| | | 54 | 5 s | 263 | 252 | | 220 | 255 | | 1 | 2 | | 3 |
| | | | 3.0 min | 274 | 247 | 101 | 254 | 206 | 97 | 1 | 1 | | 28 |
| 25 | 2 | 33 | 5 s | 53 | 109 | | 71 | 98 | | 10 | 1 | 9 | |
| | | 40 | 5 s | 270 | 241 | | 226 | 209 | | 2 | 4 | 2 | |
| | | 47 | 5 s | 204 | 231 | | 226 | | | 2 | 6 | 11 | |
| | 5 | 33 | 5 s | 175 | 224 | | 146 | 211 | | 5 | 22 | 20 | |
| | | 40 | 5 s | 222 | 241 | | 221 | 198 | | 1 | 4 | 9 | |
| | 15 | 47 | 5 s | 233 | 206 | | 235 | 216 | | 2 | 1 | 2 | |
| | | | 3.0 min | | 215 | 98 | 229 | 218 | 99 | 1 | 2 | 1 | |
| | 40 | 33 | 5 s | 157 | 169 | | 214 | 228 | | 1 | 3 | | 4 |
| | | 40 | 5 s | 194 | 214 | | 264 | 208 | | 2 | 2 | | 15 |
| 40 | 2 | 33 | 5 s | 185 | 188 | | 178 | 187 | | 8 | 10 | 17 | |
| | | | 3.0 min | 211 | 197 | 109 | 180 | 170 | 96 | 3 | 13 | | 15 |
| | | 54 | 5 s | 196 | 235 | | 296 | 212 | | 2 | 3 | | 14 |
| | | | 3.0 min | 199 | 234 | 100 | 247 | 204 | 89 | 1 | 3 | | 6 |
| | 5 | 33 | 5 s | 249 | 244 | | 210 | 217 | | 2 | 11 | | 24 |
| | 15 | 33 | 5 s | 244 | 235 | | 235 | 220 | | 6 | 9 | 15 | |
| | 40 | 33 | 5 s | 180 | 192 | | 187 | 196 | | 2 | 1 | | 17 |
| | | | 3.0 min | 186 | 210 | 113 | 196 | 205 | 105 | 1 | 0 | | 11 |
| | | 54 | 5 s | 160 | 224 | | 193 | 214 | | 2 | 2 | | 12 |
| | | | 3.0 min | 205 | 224 | 110 | 227 | 208 | 107 | 2 | 0 | | 9 |
| 50 | 75 | 28 | 5 s | 152 | 175 | | | | | | | | |
| | | | 3.0 min | 114 | 120 | 73 | | | | | | | |
| 80 | 120 | 28 | 5 s | 223 | 240 | | | | | | | | |
| | | | 3.0 min | 177 | 190 | 79 | | | | | | | |

TABLE 5

Bondline corrosion values after 90 days salt spray exposure of bonded samples, made of 0.5 mm and 1.6 mm AA7075-T6 alclad, by anodizing in an electrolyte comprising 25 g/l sulphuric acid and 10 g/l phosphoric acid at 45° C. (with further anodizing parameters varied), and by subsequent application of epoxy bondprimer Redux112 and bonding with 125° C. curing epoxy adhesive AF163-2K, with anodizing parameters varied.

| Anodic voltage | Anodic voltage | Anodizing substeps according FIG. 2 | | | | Bondline |
|---|---|---|---|---|---|---|
| Va1 [V] | Va2 [V] | A [min] | B/t1 [min] | C [min] | D/t2 (min] | corrosion [%] |
| 23 | | 4.6 | 12 | | | 3 |
| 23 | | 4.6 | 19 | | | 2 |
| 23 | | 4.6 | 33 | | | 2 |
| 23 | | 4.6 | 40 | | | 1 |

TABLE 5-continued

Bondline corrosion values after 90 days salt spray exposure of bonded samples, made of 0.5 mm and 1.6 mm AA7075-T6 alclad, by anodizing in an electrolyte comprising 25 g/l sulphuric acid and 10 g/l phosphoric acid at 45° C. (with further anodizing parameters varied), and by subsequent application of epoxy bondprimer Redux112 and bonding with 125° C. curing epoxy adhesive AF163-2K, with anodizing parameters varied.

| Anodic voltage | Anodic voltage | Anodizing substeps according FIG. 2 | | | | Bondline |
|---|---|---|---|---|---|---|
| Va1 [V] | Va2 [V] | A [min] | B/t1 [min] | C [min] | D/t2 (min] | corrosion [%] |
| 23 | | 11.5 | 26 | | | 1 |
| 17 | | 1.7 | 26 | | | 5 |
| 23 | | 2.3 | 26 | | | 2 |
| 11 | 23 | 2.2 | 22 | 2.4 | 4 | 1 |

TABLE 5-continued

Bondline corrosion values after 90 days salt spray exposure of bonded samples, made of 0.5 mm and 1.6 mm AA7075-T6 alclad, by anodizing in an electrolyte comprising 25 g/l sulphuric acid and 10 g/l phosphoric acid at 45° C. (with further anodizing parameters varied), and by subsequent application of epoxy bondprimer Redux112 and bonding with 125° C. curing epoxy adhesive AF163-2K, with anodizing parameters varied.

| Anodic voltage | Anodic voltage | Anodizing substeps according FIG. 2 | | | | Bondline |
|---|---|---|---|---|---|---|
| Va1 [V] | Va2 [V] | A [min] | B/t1 [min] | C [min] | D/t2 (min) | corrosion [%] |
| 11 | 29 | 2.2 | 22 | 3.6 | 4 | 3 |
| 17 | 29 | 3.4 | 22 | 2.4 | 4 | 1 |

TABLE 5-continued

Bondline corrosion values after 90 days salt spray exposure of bonded samples, made of 0.5 mm and 1.6 mm AA7075-T6 alclad, by anodizing in an electrolyte comprising 25 g/l sulphuric acid and 10 g/l phosphoric acid at 45° C. (with further anodizing parameters varied), and by subsequent application of epoxy bondprimer Redux112 and bonding with 125° C. curing epoxy adhesive AF163-2K, with anodizing parameters varied.

| Anodic voltage | Anodic voltage | Anodizing substeps according FIG. 2 | | | | Bondline |
|---|---|---|---|---|---|---|
| Va1 [V] | Va2 [V] | A [min] | B/t1 [min] | C [min] | D/t2 (min) | corrosion [%] |
| 23 | 29 | 4.6 | 22 | 1.2 | 4 | 2 |
| 23 | 11 | 4.6 | 22 | 2.4 | 4 | 7 |

TABLE 6

Dry and wet Bell peel values of various alloys and bondline corrosion values of AA2024-T3 alclad, by anodizing in an electrolyte comprising 14-33 g/l sulphuric acid and 10 g/l phosphoric acid at 46° C. and 15/19 V (with increasing metal concentration due to ageing, while sometimes sulphuric acid was added for replenishment). Sheets were provided with phenol formaldehyde bondprimer Redux101 and subsequently bonded with 125° C. curing epoxy adhesives AF163-2K or FM94 respectively.

| | | Run number | | | | | | | |
|---|---|---|---|---|---|---|---|---|---|
| | | 1 | 2 | 3 | 4 | 5 | 6 | 7 | 8 |
| Concentrations of sulphuric acid aluminium and main alloying elements | | | | | | | | | |
| Sulphuric acid (g/l) | | 15 | 21 | 30 | 25 | 17 | 22 | 33 | 21 |
| Phosphoric acid [g/l] | | 10.2 | 10.6 | 10.5 | 10.2 | 10.2 | 10.0 | 9.9 | 10.3 |
| Aluminium [g/l] | | 0.00 | 0.05 | 0.09 | 1.23 | 2.47 | 2.56 | 2.56 | 4.79 |
| Cupper (mg/l) | | 0 | | | | | | | |
| Zinc (mg/l) | | 0 | | | | | | | |
| Iron (mg/l) | | 0 | | | | | | | |
| Peel values of 0.5 mm and 1.6 mm AA2024-T3 alclad provided with Redux101 and bonded with AF163 (N/25 mm) | | | | | | | | | |
| AF163 | #1 | 287 | 264 | 290 | 292 | 301 | 249 | 248 | 242 |
| dry | #2 | 252 | 270 | 256 | 260 | 246 | 249 | 238 | 245 |
| AF163 | #1 | 307 | 316 | 300 | 278 | 296 | 239 | 257 | 267 |
| Wet | #2 | 169 | 274 | 255 | 284 | 256 | 247 | 234 | 241 |
| Peel values of 0.5 mm and 1.6 mm AA2024-T3 alclad provided with Redux101 and bonded with FM94 (N/25 mm) | | | | | | | | | |
| FM94 | #1 | | 199 | | 201 | | 215 | | 161 |
| dry | #2 | | 201 | | 211 | | 209 | | 172 |
| FM94 | #1 | | 216 | | 219 | | 216 | | 189 |
| Wet | #2 | | 188 | | 216 | | 220 | | 173 |
| Peel values of 0.5 mm and 1.6 mm AA2024-T3 bare, provided with Redux101 and bonded with AF163 (N/25 mm) | | | | | | | | | |
| AF163 | #1 | 266 | 273 | 294 | 300 | 277 | 295 | 274 | 300 |
| dry | #2 | 249 | 244 | 261 | 302 | 241 | 262 | 240 | 253 |
| AF163 | #1 | 264 | 254 | 256 | 267 | 262 | 252 | 256 | 225 |
| Wet | #2 | 251 | 261 | 248 | 268 | 238 | 238 | 232 | 231 |
| Peel values of 0.5 mm and 1.8 mm AA7075-T6 bare, provided with Redux101 and bonded with AF163 (N/25 mm) | | | | | | | | | |
| AF163 | #1 | 252 | 273 | 285 | 294 | 258 | 271 | 260 | 288 |
| dry | #2 | 241 | 237 | 226 | 247 | 246 | 225 | 247 | 247 |
| AF163 | #1 | 271 | 277 | 282 | 285 | 253 | 275 | 259 | 238 |
| Wet | #2 | 250 | 232 | 228 | 236 | 246 | 215 | 221 | 229 |
| Bondline corrosion values of 0.5 mm and 1.6 mm AA2024-T3 alclad, provided with Redux101 and bonded with AF163 (%)* | | | | | | | | | |
| AF163 90 days | #3 | 8.3 | 3.5 | 8.7 | 11 | | 8.1 | 6.1 | 7.8 |
| Salt spray | #4 | 2.0 | 9.1 | 7.0 | 1.6 | 3.7 | 9.1 | 2.4 | 6.5 |

TABLE 6-continued

Dry and wet Bell peel values of various alloys and bondline corrosion values of AA2024-T3 alclad, by anodizing in an electrolyte comprising 14-33 g/l sulphuric acid and 10 g/l phosphoric acid at 46° C. and 15/19 V (with increasing metal concentration due to ageing, while sometimes sulphuric acid was added for replenishment). Sheets were provided with phenol formaldehyde bondprimer Redux101 and subsequently bonded with 125° C. curing epoxy adhesives AF163-2K or FM94 respectively.

| Bondline corrosion values of 0.5 mm and 1.6 mm AA2024-T3 alclad, provided with Redux101 and bonded with FM94 (%)* | | | | | |
|---|---|---|---|---|---|
| FM94 90 days | #3 | 2.6 | 5.8 | 2.5 | 1.9 |
| Salt spray | #4 | 0.9 | 3.2 | 4.3 | 2.2 |
| FM94 180 days | #5 | 7.5 | 11 | 4.1 | 5.7 |
| Salt spray | #6 | 3.5 | 8.8 | 8.3 | 7.3 |

| | | Run number | | | | | | |
|---|---|---|---|---|---|---|---|---|
| | | 9 | 10 | 11 | 12 | 13 | 14 | 15 |
| Concentrations of sulphuric acid aluminium and main alloying elements | | | | | | | | |
| Sulphuric acid (g/l) | | 14 | 20 | 28 | 22 | 16 | 22 | 30 |
| Phosphoric acid [g/l] | | 10.5 | 10.5 | 10.4 | 9.9 | 9.8 | 9.8 | 9.8 |
| Aluminium [g/l] | | 5.95 | 6.03 | 6.10 | 7.39 | 8.66 | 8.55 | 8.50 |
| Cupper (mg/l) | | 254 | 222 | 194 | 192 | 101 | 96 | 291 |
| Zinc (mg/l) | | 79 | 79 | 80 | 96 | 114 | 113 | 114 |
| Iron (mg/l) | | 21 | 21 | 21 | 21 | 24 | 24 | 26 |
| Peel values of 0.5 mm and 1.6 mm AA2024-T3 alclad provided with Redux101 and bonded with AF163 (N/25 mm) | | | | | | | | |
| AF163 | #1 | 289 | 277 | 252 | 247 | 260 | 274 | 265 |
| dry | #2 | 252 | 268 | 242 | 247 | 259 | 257 | 229 |
| AF163 | #1 | 238 | 266 | 259 | 214 | 226 | 260 | 242 |
| Wet | #2 | 227 | 241 | 227 | 242 | 239 | 287 | 227 |
| Peel values of 0.5 mm and 1.6 mm AA2024-T3 alclad provided with Redux101 and bonded with FM94 (N/25 mm) | | | | | | | | |
| FM94 | #1 | | 204 | | 192 | | 159 | |
| dry | #2 | | 204 | | 173 | | 174 | |
| FM94 | #1 | | 195 | | 200 | | 181 | |
| Wet | #2 | | 194 | | 179 | | 188 | |
| Peel values of 0.5 mm and 1.6 mm AA2024-T3 bare, provided with Redux101 and bonded with AF163 (N/25 mm) | | | | | | | | |
| AF163 | #1 | 290 | 277 | 279 | 294 | 317 | 301 | 309 |
| dry | #2 | 280 | 264 | 285 | 273 | 299 | 271 | 274 |
| AF163 | #1 | 239 | 260 | 227 | 245 | 245 | 234 | 298 |
| Wet | #2 | 251 | 271 | 260 | 254 | 252 | 254 | 267 |
| Peel values of 0.5 mm and 1.8 mm AA7075-T6 bare, provided with Redux101 and bonded with AF163 (N/25 mm) | | | | | | | | |
| AF163 | #1 | 263 | 257 | 272 | 267 | 297 | 274 | 264 |
| dry | #2 | 248 | 233 | 237 | 246 | 244 | 238 | 235 |
| AF163 | #1 | 218 | 227 | 237 | 243 | 262 | 243 | 265 |
| Wet | #2 | 231 | 238 | 238 | 224 | 253 | 234 | 224 |
| Bondline corrosion values of 0.5 mm and 1.6 mm AA2024-T3 alclad, provided with Redux101 and bonded with AF163 (%)* | | | | | | | | |
| AF163 90 days | #3 | 15 | 3.8 | 8.8 | 15 | 13 | 19 | 18 |
| Salt spray | #4 | 10 | 11 | 15 | 26 | 8.0 | 9.5 | 13 |
| Bondline corrosion values of 0.5 mm and 1.6 mm AA2024-T3 alclad, provided with Redux101 and bonded with FM94 (%)* | | | | | | | | |
| FM94 90 days | #3 | | 2.9 | | 2.6 | | 1.3 | |
| Salt spray | #4 | | 1.3 | | 2.9 | | 2.5 | |
| FM94 180 days | #5 | | 6.0 | | 9.1 | | 7.6 | |

TABLE 6-continued

Dry and wet Bell peel values of various alloys and bondline corrosion values of AA2024-T3 alclad, by anodizing in an electrolyte comprising 14-33 g/l sulphuric acid and 10 g/l phosphoric acid at 46° C. and 15/19 V (with increasing metal concentration due to ageing, while sometimes sulphuric acid was added for replenishment). Sheets were provided with phenol formaldehyde bondprimer Redux101 and subsequently bonded with 125° C. curing epoxy adhesives AF163-2K or FM94 respectively.

| | | | | |
|---|---|---|---|---|
| Salt spray | #6 | 2.8 | 4.1 | 8.5 |

Table 6 shows that at aluminum concentrations below 5 g/l (Run no. 1-8) average bondline corrosion of AA2024-T3 alclad bonded with AF163-2K is less than 10%, which is considered acceptable in industry. At higher concentrations (Run no. 9-15) average bondline corrosion increases to an undesired level.

The invention claimed is:

1. A method of anodizing an article of aluminum or aluminum alloy for applying a porous anodic oxide coating in preparation of the subsequent application of an adhesive bonding layer and/or a primer layer, comprising:

immersing the article in an electrolyte in a tank, wherein the electrolyte comprises an aqueous solution of sulphuric acid andphosphoric acid, and arranging the article as an anode with respect to one or more counter electrodes that are arranged as cathodes in the electrolyte; and anodizing by applying a positive anode voltage Va to the article switched as anode, wherein the concentration of sulphuric acid in the electrolyte is in the range of 10-40 g/l, the concentration of phosphoric acid in the electrolyte is in the range of 2-40 g/l, the temperature of the electrolyte is in the range of 33-60° C. during the anodizing, and the anodizing time is in the range of 15-35 minutes;

wherein the electrolyte is maintained at an aluminum concentration of at most 4.8 g/l; and the voltage is varied to achieve a current density of $0.8\pm0.4$ A/dm$^2$, wherein the anodizing is followed by a rinsing step performed approximately 3 minutes after the anodizing.

2. The method of claim 1, wherein the rinsing step comprises rinsing the anodized article with a rinsing agent.

3. The method claim 1, wherein the phosphoric acid concentration is in the range of 4-16 g/l.

4. The method of claim 1, wherein the temperature of the electrolyte is in the range of 40-54° C.

5. The method of claim 1, wherein the anode voltage is in the range of 8-34 V.

6. The method of claim 1, wherein the electrolyte is free from additional corrosion inhibitors.

7. The method of claim 1, wherein the anodizing comprises:

increasing the applied anode voltage at a gradient of 1-10 V/minute to a first valuein the range of 8-34 V, maintaining the applied anode voltage at said first value for a first anodizing time, raising the applied anode voltage to a second value in the range of 8-34 V, which second value is higher than the first value, and maintaining the applied anode voltage at said second value for a second anodizing time.

8. The method of claim 7, wherein the second anodizing time is less than the first anodizing time.

9. A method of manufacturing a painted anodized article, comprising:

immersing the article in an electrolyte in a tank, wherein the electrolyte comprises an aqueous solution of sulphuric acid andphosphoric acid, and arranging the article as an anode with respect to one or more counter electrodes that are arranged as cathodes in the electrolyte;

anodizing by applying a positive anode voltage Va to the article switched as anode, wherein the concentration of sulphuric acid in the electrolyte is in the range of 10-40 g/l, the concentration of phosphoric acid in the electrolyte is in the range of 2-40 g/l, the temperature of the electrolyte is in the range of 33-60° C. during the anodizing, and the anodizing time is in the range of 15-35 minutes;

applying a paint primer to a surface to be painted of the anodized article; and painting the primed surface of the article;

wherein the electrolyte is maintained at an aluminum concentration of at most 4.8 g/l; and the voltage is varied to achieve a current density of $0.8\pm0.4$ A/dm$^2$, wherein the anodizing is followed by a rinsing step performed approximately 3 minutes after the anodizing.

10. The method of claim 9, wherein a chromate (Cr(VI)) free bonding primer is applied to the anodized article prior to the application of the paint primer.

11. A method of manufacturing a metal bonded product comprising at least two metal articles of aluminum or aluminum alloy bonded to one another by means of an adhesive, comprising:

providing the at least two metal articles that were anodized by immersing the respective articles in an electrolyte in a tank, wherein the electrolyte comprises an aqueous solution of sulphuric acid and phosphoric acid, and arranging the respective article as an anode with respect to one or more counter electrodes that are arranged as cathodes in the electrolyte;

anodizing by applying a positive anode voltage Va to the respective article switched as anode, wherein the concentration of sulphuric acid in the electrolyte is in the range of 10-40 g/l, the concentration of phosphoric acid in the electrolyte is in the range of 2-40 g/l, the temperature of the electrolyte is in the range of 33-60° C. during the anodizing, and the anodizing time is in the range of 15-35 minutes;

applying a layer of a bonding primer to surfaces of the metal articles to be bonded together;

applying a layer of an adhesive to at least one of the surfaces to be bonded on top of the layer of bonding primer;

stacking the at least two metal articles such that surfaces of the articles to which at least the layer of bonding primer is applied face each other; and bonding the stacked metal articles together under elevated pressure;

wherein the electrolyte is maintained at an aluminum concentration of at most 4.8 g/l; and the voltage is varied to achieve a current density of $0.8\pm0.4$ A/dm$^2$, wherein the anodizing is followed by a rinsing step performed approximately 3 minutes after the anodizing.

12. The method of claim 11, wherein the at least two metal articles are metal sheets of aluminum or aluminum alloy, whereby the metal bonded product is a metal bonded laminate.

13. The method of claim 12, wherein the adhesive is a fiber-reinforced adhesive or the adhesive is impregnated into reinforcing fibers, so that the metal bonded product is a fiber metal laminate.

14. The method of claim 11, wherein the bonding primer is a chromate (Cr(VI)) free bonding primer.

15. A method of anodizing an article of aluminum or aluminum alloy for applying a porous anodic oxide coating in preparation of the subsequent application of an adhesive bonding layer and/or a primer layer, comprising:

immersing the article in an electrolyte in a tank, wherein the electrolyte comprises an aqueous solution of sulphuric acid and phosphoric acid, and arranging the article as an anode with respect to one or more counter electrodes that are arranged as cathodes in the electrolyte; and anodizing by applying a positive anode voltage Va to the article switched as anode, wherein the concentration of sulphuric acid in the electrolyte is in the range of 10-40 g/l, the concentration of phosphoric acid in the electrolyte is in the range of 2-40 g/l, the temperature of the electrolyte is in the range of 33-60° C. during the anodizing, and the anodizing time is in the range of 15-35 minutes, wherein the anodizing comprises:

increasing the applied anode voltage at a gradient of 1-10 V/minute to a first value in the range of 8-34 V;

maintaining the applied anode voltage at said first value for a first anodizing time, the first anodizing time being 10-15 minutes;

raising the applied anode voltage to a second value in the range of 8-34 V, which second value is higher than the first value; and maintaining the applied anode voltage at said second value for a second anodizing time, the second anodizing time being 2-5 minutes;

wherein the electrolyte is maintained at an aluminum concentration of at most 4.8 g/l; and the first and second applied anode voltages are maintained at respective values to achieve a current density of $0.8\pm0.4$ A/dm$^2$, wherein the anodizing is followed by a rinsing step performed approximately 3 minutes after the anodizing.

16. The method of claim 1, wherein, after anodizing, the porous anodic oxide coating is capable of achieving 10% or less bondline corrosion in response to a neutral salt spray duration of 180 days.

17. The method of claim 1, further comprising drying the rinsed anodized article.

* * * * *